US006684871B1

(12) United States Patent
Troncoso et al.

(10) Patent No.: US 6,684,871 B1
(45) Date of Patent: Feb. 3, 2004

(54) PUSH-AWAY ARROW REST

(76) Inventors: Vincent Troncoso, 14090-6100 Rd., Montrose, CO (US) 81402; Freddie Troncoso, 16990 Wildwood Dr., Montrose, CO (US) 81401

( * ) Notice: Subject to any disclaimer, the term of this patent is extended or adjusted under 35 U.S.C. 154(b) by 0 days.

(21) Appl. No.: 10/237,780

(22) Filed: Sep. 9, 2002

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS 3,504,659 A 4/1970 Babington
3,935,854 A 2/1976 Troncosco, Jr.
5,365,912 A 11/1994 Pittman
5,394,858 A 3/1995 Karolian
5,415,154 A 5/1995 Angeloni
5,490,492 A 2/1996 Savage
5,632,263 A 5/1997 Sartain
6,044,832 A 4/2000 Piersons, Jr.
6,202,635 B1 * 3/2001 Evans ..... 124/44.5

* cited by examiner

*Primary Examiner*—John A. Ricci
(74) *Attorney, Agent, or Firm*—Gerald E. Helget; Nelson R. Capes; Briggs and Morgan

(57) ABSTRACT

A push-away arrow rest for use with a compound bow includes an arrow launcher assembly biased to an upward arrow support position. A push rod assembly is biased away from the arrow launcher assembly and is adapted to push the arrow launcher assembly downward out of the way of an arrow and its fletching after the arrow is drawn and released from the bow. The push rod assembly is struck by the tuning cables which in turn strikes a rotator lever connected to the arrow launcher assembly which pushes the arrow rest down and out of the way of the arrow and its fletching within micro seconds.

29 Claims, 3 Drawing Sheets

PUSH-AWAY ARROW REST

BACKGROUND OF THE INVENTION:

The present invention relates generally to an arrow rest assembly for use with a compound bow. More particularly, the present invention relates to a push-away arrow rest which provides for a more accurate, reliable and unimpeded discharge of an arrow from a compound bow.

Archery and shooting with bows and arrows have existed since prehistoric times. The first bows were long bows of wood with integral upper and lower arms and one string connected to the ends of the arms for knocking an arrow thereto while the thumb of one hand supported the arrow at the handgrip location. For many years archery has been one of the competitions in the Olympic games, recognizing the worldwide acceptance of archery as a past and present life necessity and sport.

During the late 1960's and early 1970's, archery underwent radical changes in equipment. Long bows and/or recurve bows were replaced by the compound bow invented by Holless Allen. The compound bow utilizes a combination of pulleys, eccentric wheels and cables that provide increased arrow speed and improved accuracy. This combination produces a much enhanced mechanical advantage not present in traditional archery equipment.

Other improvements added to the compound bow included the use of hand held mechanical release devices that improve efficiency and accuracy accounting for unbelievable record scores that are being shot today. Various designs of arrow rests have also been added to the compound bow. An arrow rest supports the arrow as it is placed into the shelf region of the bow. The arrow rest further supports the arrow as it is drawn back after being nocked to the bow string, and further supports the arrow as it moves forward and is launched away from the bow.

Arrows, that are shot by bows, have also improved. However, arrows still have vanes or fletching opposite the tip end and adjacent the nock. The vanes or feathers give the arrow aerodynamic advantage and encourage a rotational flight. Compound bows today can send an arrow traveling up to three hundred feet or more per second. This significant transfer of energy to the arrow from the compound bow induces great amount of paradox to the arrow that contorts and flexes the arrow shaft both in vertical and horizontal planes. These undesirable and prevalent contortions and gyrations cause the arrow shaft, along with its corresponding vanes or fletching, to collide with the arrow rest components upon release of the bow string. Such detrimental action has an affect on the accuracy of the arrow.

Arrow rests have been over the years designed to minimize contact with the fletching or vanes of the arrow as well as the arrow itself as it leaves the bow at phenomenal speeds. Support prongs actually holding the arrows have been minimized. Troncoso U.S. Pat. No. 3,939,584 discloses a traditional arrow rest and does not move out of the way of the arrow. Also numerous attempts have been made to remove the arrow rest from its launching position as the arrow and its vanes or fletching pass thereby. Once such design of a pulldown fall-away arrow rest uses the recoil or inertia of the bow upon release to move a small counter weight that trips and causes a spring loaded devise to fall and lay down on the arrow rest shelf as the bow is shot. This device requires the arrow rest be cocked before each and every shot. The Babington U.S. Pat. No. 3,504,659 shows an arrow rest that has such a cocked position and also shows a connection with the bow string activating and controlling the arrow rest. The following patent numbers, including Savage U.S. Pat. No. 5,490,492, Piersons U.S. Pat. No. 6,044,832, Sartain U.S. Pat. No. 5,632,263, Karolian U.S. Pat. No. 5,394,858 and Pittman U.S. Pat. No. 5,365,912, show arrow rests that are lifted up by way of connection to the tuning cables into the firing or arrow support position as the bow is drawn back. The Angeloni U.S. Pat. No. 5,415,154 shows a drop-away arrow rest that is mechanically interlocked with the cable slide which receives the tuning cables and is mounted on the cable guard.

Today, all of the current fall-away or drop-away arrow rest are similarly attached to the cable guard, cable slide, the cross over timing cables or the bow string itself. Most of these mechanical connections attached to these moving components use rubber tubing, elastic or synthetic string materials or mechanical links which are subject to wear and tear and eventual failure or malfunction of the arrow rest. These fall-away or drop-away arrow rests require that the bow string be drawn and pulled before the arrow support assembly rises and is pulled to an erect position in relation to the shelf and in support of the arrow in preparation of the shot. One significant problem with this design is that the arrow shaft tends to fall off the shelf or arrow rest assembly which frustrates the archer as he is concentrating on the target and preparing for the shot. There are also exists to some degree interference with the return path of the cable slide, bow string and tuning cables.

There is a need for an improved arrow rest that remains in a ready shooting position as the arrow is loaded into the bow and the bow string is drawn back in preparation for launching. Such an arrow rest should not attach to tuning cables, cables slide or the bow string of a compound bow nor interfere with the return path of the bow string, cables or cable slide. Such an improved arrow rest should be available as a retrofit or add-on to any compound bow.

SUMMARY OF THE INVENTION

A push-away arrow rest for use with a compound bow includes an arrow launcher assembly biased to an upward arrow support position. A push rod assembly is biased away from the arrow launcher assembly and is adapted to push the arrow launcher assembly downward out of the way of an arrow and its fletching after the arrow is released from the bow. The push rod assembly is struck by the tuning cables which in turns strikes a rotator lever connected to the arrow launcher assembly which pushes the arrow rest down and out of the way of the arrow and its fletching within micro seconds.

A principal object and advantage of the present invention is that the improved drop-away rest remains in a ready shooting position unlike any of the other drop-away or fall-away arrow rests which improves the archers concentration.

Another object and advantage of the present invention that the arrow rest remains in its ready shooting position which minimizes the tendency of the arrow shaft to fall off the arrow rest assembly as the archery is concentrating on the target.

Another object and advantage of the present invention is that the push-away arrow rest does not attach to the bow string, tuning cable or cable slide as to interfere with their return path or create wear and tear or failure on these mechanical components of the compound bow.

Another object and advantage of the improved arrow rest is that it is available as a retrofit or an add-on unit to the compound bow.

Another object and advantage of the present invention is that the push-away arrow rest returns and resets itself to the ready shooting position after each and every shot.

Another object and advantage of the present arrow rest is that it is fully adjustable to accurately tune for a perfect shot of any arrow as well as fully adaptable for any compound bow with further adjustability as to tension and bias.

BRIEF DESCRIPTION OF THE DRAWINGS:

FIG. 1 is a left rear perspective view of the push-away arrow rest on a compound bow broken away;

FIG. 2 is a right rear perspective view of the push-away arrow rest on a compound bow broken away;

DETAILED SPECIFICATIONS

Figure 10:
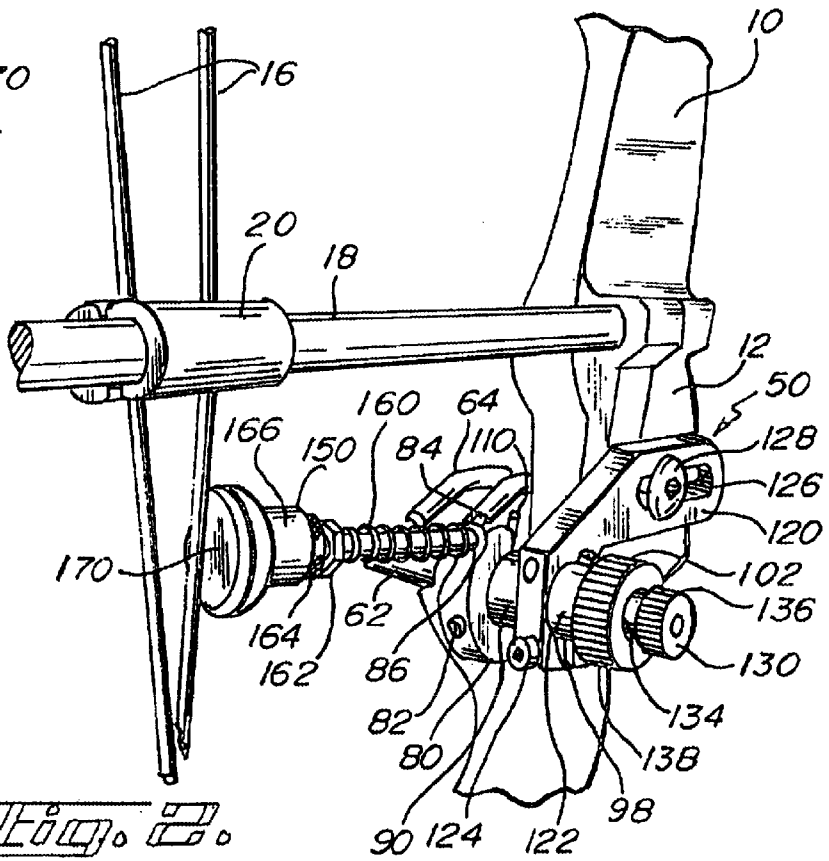
Figure 11:
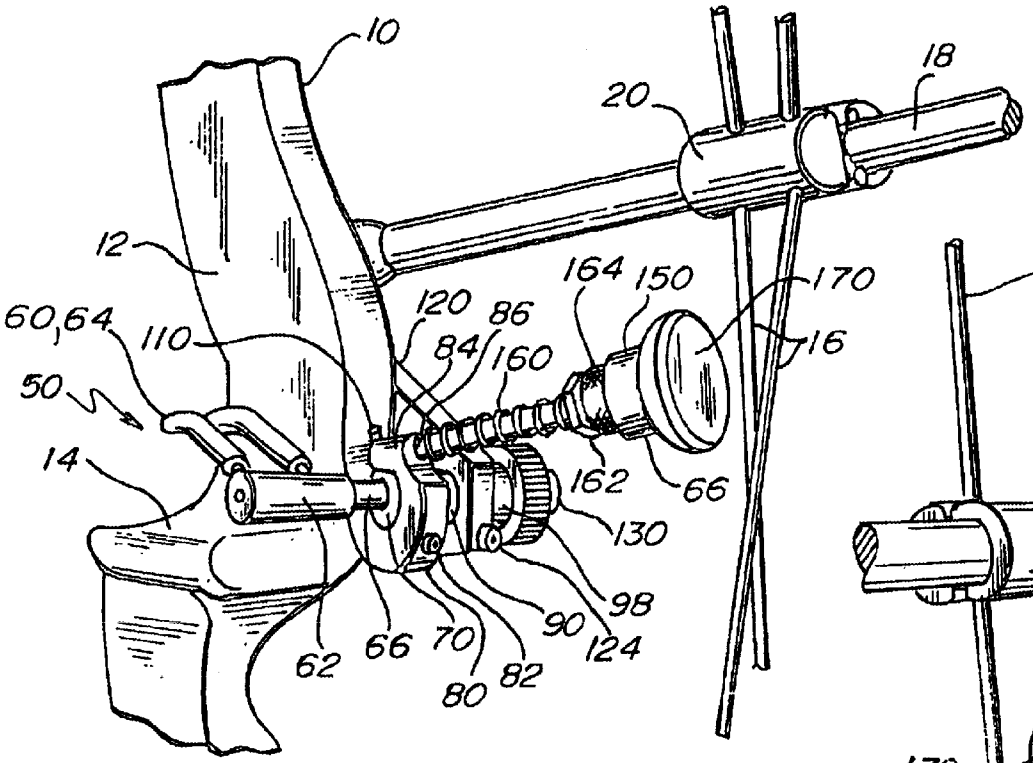

Referring to FIGS. 1 through 5, the push-away arrow rest (50) of the present invention may be appreciated. By way of environment, the compound archery bow (10) includes a riser (12) which includes shelf (14) which is in the vicinity where arrow rests are mounted. Tuning cables (16) are supported by a cable guard (18) which supports cable slide (20) which further captures tuning cables (16).

The push-away arrow rest (50) of the present invention includes arrow rest of launcher assembly (60). The arrow rest is supported by base (62) from which arrow support prongs or members (64) extend and are mounted thereto. From base (62) extends shaft (66) for mounting the base (62) within the arrow launcher assembly (60).

Figure 3:
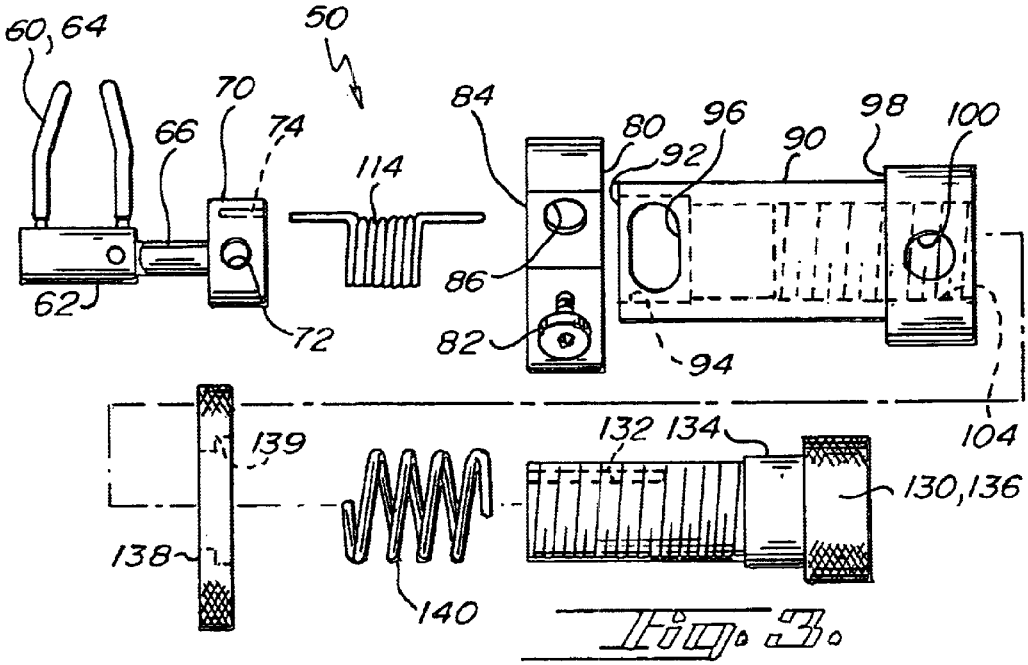
FIG. 3 is an exploded view of the launcher assembly of the present invention.
Figure 4:
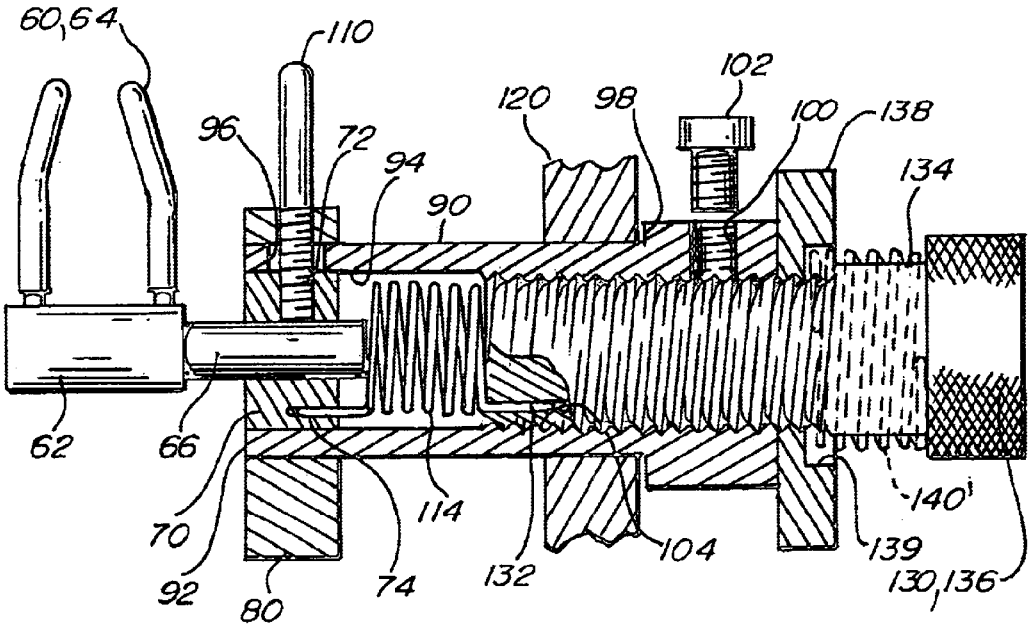
FIG. 4 is a partial cross sectional view of the assembled arrow rest less the push rod assembly.

Specifically shown in FIGS. 3 and 4, shaft (66) is received by internal collar (70) which has a transverse threaded aperture (72) and a spring retaining aperture (70). Push rod external mounting collar (80) is generally aligned with internal collar (70) as will be appreciated and locked into position with set screws (82). External push rod collar (80) supports a push rod mounting shoulder (84) which has an aperture (86) therethrough.

Internal launcher collar (70) and external push rod collar (80) are mounted to the launcher side (92) of barrel (90). Internal collar (70) is placed into the axial barrel opening (94). Barrel (90) also has a circumferential slot (96), mounting bracket shoulder (98) and transverse threaded aperture (100) which receives set screw (102) as will be appreciated. Barrel (90), opposite the launcher side opening side (94), has its threaded side of barrel opening (104).

Once the internal collar (70) with the arrow support prong (64) and shaft (66) is in place in the axial barrel opening (94), transverse threaded aperture (72) is aligned with the barrel's circumferential slot (96) after which a threaded rotator lever (110) is placed into the transverse threaded aperture (72) of the internal collar (70). As will be appreciated, the arrow rest launcher assembly (60) is now mounted to barrel (90) and may be axially rotated by movement of the rotator lever (110).

Torsion spring (114) may be preloaded as to fit within spring retaining aperture (74) of internal collar (70) while the other end of torsion spring (114) will fit within the torsion spring retaining aperture (132) of the threaded tension adjustment screw (130) more fully described below.

Barrel (90) is secured to the archery bow (10) by mounting bracket (120). That is, barrel (90) is located within barrel split aperture (122) of bracket (120) and secured thereat by barrel mounting set screw or screws (124). Bracket (120) supports a riser mounting slot (126) which permits a set screw (128) to be secure the mounting bracket to riser (12).

Threaded tension adjustment screw (130) is to be rotatably placed within the transverse threaded aperture (100) of barrel (90) as to permit the torsion spring retaining aperture (132) to capture and secure the torsion spring (114). Tension adjustment screw has a shoulder (134) and a gripable knurled knob (136). Knurled lock ring (138) locks the adjustments screw in relation to the barrel (90). Knurled lock ring (138) also has a spring seat (139) as to receive compression optional spring (140) as it rests on shoulder (134) of adjustment screw (130).

Push rod assembly (150) has a head (152) which contacts the rotator lever (110) and extends from shaft (154). Opposite head (152) is threaded end (156) of shaft (154). A compression or coil return spring (160) fits over shaft (154) and is secured by tension nut (162) which is further locked by threaded locking knob (164). Cable bumper (166) is then secured onto threaded end (156) by its internal threads (168) and may be rotated for length adjustment of the push rod assembly (150). Replaceable cushion (170) is optionally placed over the cable bumper (166).

Figures 5, 6, 7, 8, 9:
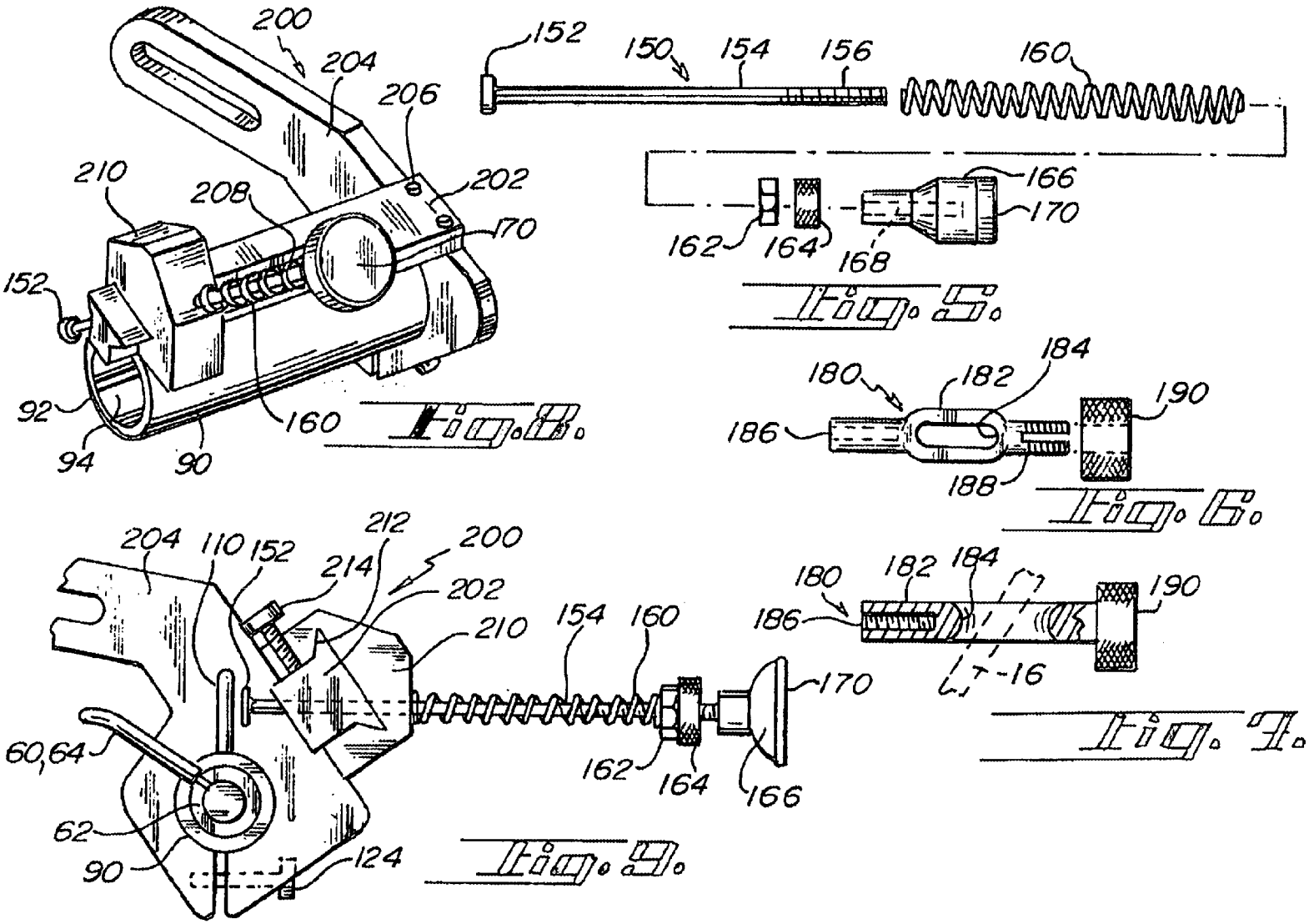
FIG. 5 is an exploded view of the push rod assembly.
FIG. 6 is an exploded view of a second embodiment of a push rod assembly.
FIG. 7 is an assembled view of the second embodiment of the push rod assembly of FIG. 6.
FIG. 8 is a third embodiment of the push rod assembly in perspective.
FIG. 9 is a side elevation view of the third embodiment of the push rod assembly and arrow launch assembly of FIG. 8.

FIGS. 6 through 9 show second and third embodiments of the push rod assembly of the present invention. A second push rod assembly embodiment (180) includes a cable retainer (182) instead of a bumper (166). Retainer (182) includes an elongate radiused slot (184) which will not wear on the tuning cables (116). The retainer (182) has a threaded rod end (186) for securement to the shaft (15A) and a threaded split cap end (188) to permit insertion of tuning cable (16) and enclosure by the internally threaded cap (190) as shown assembled in FIG. 9. The third embodiment of the push rod assembly mount (200) is depicted in FIGS. 8 and 9. Dovetailed bracket (202) is mounted to mounting bracket (204) by set screws (206). The dovetailed bracket (202) has a push rod slot (208) to permit lateral alignment of the push rod assembly. A push rod block (210) supports the shaft (154) as it passes therethrough block (210) and slotted channel (212). Block (210) is fit onto the dovetailed bracket (202) and secured once property aligned by set screw (214).

With the components of the push-away arrow rest (50) assembled, the mounting of the push-away arrow rest (50) onto the compound bow (10) and its adjustment for tuning may now be appreciated. Mounting bracket (20) is secured to riser (20) and the forward and rearward adjustment of the push-away arrow rest (50) is made after which set screw (28) locks the bracket (120) to riser (12).

The left and right alignment of the launcher assembly (60) can be adjusted by moving the vertical arrow support prongs or members (64) or shaft (66) and tightening lever (110) or by locating the barrel (90) left or right in the barrel split aperture and then tightening the barrel mounting set screw (124). The push rod assembly (150) supported by the external push rod mounting collar (80) is aligned with the rotator lever (110) and set screw (82) tightened.

The tension of the arrow rest launcher assembly (60) under the influence of torsion spring (114) is adjusted by the threaded tension screw (130) Optional compression spring (140), together with the knurled lock ring (138) tend to hold the tension adjustment screw (130) locked in place. With the knurled lock ring (138) and set screw (102)backed off, the tension adjustment screw (130) may be turned inwardly to strengthen the rotational bias of the launcher assembly (160). After the bias is adjusted, set screw (102) may be secured in place as well as knurled lock ring (138).

The push rod assembly (150) is easily adjusted and fine tuned. As shaft (154) slides within aperture (86) of the push rod external mounting collar (80), head (152) is biased away from rotator lever (110) by action of compression spring (160) which is mounted over shaft (150) and secured there by tension nut (162). Threading down tension nut (162) compresses the spring (160) and increases the bias of head (152) away from rotator lever. Once the bias is set, threaded locking knob (164) secures tension nut (162) in place.

The cable bumper (166) has internal threads threaded onto the threaded end (156) of shaft (154). Longitudinal adjustment may be made by rotating the cable bumper (166) adjacent the tuning cable (16) as shown in FIGS. 1 and 2.

Once the push-away arrow rest (50) is adjusted and tuned, the compound bow is ready for arrow shooting. An arrow shaft is placed upon the support prongs (64) as the nock of the arrow is secured to the bow string. The launcher assembly (60) is in its upright ready to fire position. The bow string is then drawn back and the tuning cable (16) and cable slide (20) move waywardly a couple of inches along cable guard (18). Once the bow string is released, the tuning cables (16) come forwardly striking the cable bumper (166) which permits the head (152) to strike the rotator lever (110) and cause the arrow support prongs (64) of the launcher assembly to rotate downwardly out of the way of the flight of the arrow and fletching. This all occurs within split microseconds. After the arrow has left the bow (10) and the tuning cable (16) recoils to the static position, the arrow launcher assembly (60) returns to its upright ready position for the next arrow.

The second embodiment of the push rod assembly (180) operates similarly to the cable bumper (166) except the tuning cable (116) strikes the cable retainer (182) which captures the cable (16). The third embodiment of the push rod assembly (200) simply mounts the push rod assembly (150) to the mounting bracket (120) as is obvious.

The forgoing descriptions and figures are to be interpreted as being illustrative and exemplary embodiments of the invention. The true scope of the invention is to be considered upon a review of the claims as follows.

What is claimed:

1. A push-away arrow rest for use with a compound bow, the bow comprising a riser having a shelf, a cable guard, a cable slide and at least one tuning cable, the rest comprising:

a) an arrow launcher assembly biased to an upward arrow support position; and b) a push rod assembly biased away from the arrow launcher assembly adapted to push the arrow launcher assembly downwardly out of the way of an arrow after the arrow is drawn and released by the bow.

2. The push-away arrow rest of claim 1, wherein the tuning cable strikes the push rod assembly which in turn strikes and pushes the arrow launcher assembly downwardly out of the way of the arrow as the arrow is launched.

3. The push-away arrow rest of claim 1, wherein the arrow launcher assembly comprises an arrow support member rotatably mounted to the riser in the area of the shelf.

4. The push-away arrow rest of claim 3, wherein the arrow support member is supported by a base with a shaft biased and rotatably mounted in a barrel fixedly secured in relation to the riser.

5. The push-away arrow rest of claim 1, wherein the push rod assembly is fixedly secured in relation to the riser.

6. The push-away arrow rest of claim 5, wherein the push rod assembly is mounted on a barrel fixedly secured to the riser.

7. The push-away arrow rest of claim 6, wherein the push rod assembly comprises a shaft with a head for striking and moving the arrow launcher assembly downwardly from it biased upward position, a cable bumper on the shaft opposite the head adjacent the turning cable and a compression spring on the shaft biasing the head away from the arrow launching assembly.

8. The push-away arrow rest of claim 1, further comprising a rotator lever rigidly connected to the arrow launcher assembly and aligned adjacent the head of the push rod assembly.

9. The push-away arrow rest of claim 1, wherein the push rod assembly is adjustable in length and biased tension.

10. A push-away arrow rest for use with a compound bow, the bow comprising a riser having a shelf, a cable guard, a cable slide and at least one tuning cable, the rest comprising:

a) an arrow launcher assembly biased to an upward arrow support position; and b) a push rod assembly biased away from the arrow launcher assembly wherein the tuning cable strikes the push rod assembly which in turn strikes and pushes the arrow launcher assembly downwardly out of the way of an arrow after the arrow is drawn and released by the bow.

11. The push-away arrow rest of claim 10, wherein the arrow launcher assembly comprises an arrow support member rotatably mounted to the riser in the area of the shelf.

12. The push-away arrow rest of claim 11, wherein the arrow support member is supported by a base with a shaft biased and rotatably mounted in a barrel fixedly secured in relation to the riser.

13. The push-away arrow rest of claim 10, wherein the push rod assembly is fixedly secured in relation to the riser.

14. The push-away arrow rest of claim 13, wherein the push rod assembly is mounted on a barrel fixedly secured to the riser.

15. The push-away arrow rest of claim 14, wherein the push rod assembly comprises a shaft with a head for striking and moving the arrow launcher assembly downwardly from it biased upward position, a cable bumper on the shaft opposite the head adjacent the turning cable and a compression spring on the shaft biasing the head away from the arrow launching assembly.

16. The push-away arrow rest of claim 10, further comprising a rotator lever rigidly connected to the arrow launcher assembly and aligned adjacent the head of the push rod assembly.

17. The push-away arrow rest of claim 10, wherein the push rod assembly is adjustable in length and biased tension.

18. A push-away arrow rest for use with a compound bow, the bow comprising a riser having a shelf, a cable guard, a cable slide and at least one tuning cable, the rest comprising:

a) an arrow launcher assembly rotatably mounted to the riser and biased to an upward arrow support position; and b) a push rod assembly fixedly secured in relation to the riser and biased away from the arrow launcher assembly adapted to push the arrow launcher assembly downwardly out of the way of an arrow after the arrow is drawn and released by the bow.

19. The push-away arrow rest of claim 18, wherein the tuning cable strikes the push rod assembly which in turn strikes and pushes the arrow launcher assembly downwardly out of the way of the arrow as the arrow is launched.

20. The push-away arrow rest of claim 18, wherein the arrow support member is supported by a base with a shaft rotatably biased mounted in a barrel fixedly secured to the riser.

21. The push-away arrow rest of claim 18, wherein the push rod assembly is mounted on a barrel fixedly secured to the riser.

22. The push-away arrow rest of claim 21, wherein the push rod assembly comprises a shaft with a head for striking and moving the arrow launcher assembly downwardly from it biased upward position, a cable bumper on the shaft opposite the head adjacent the turning cable and a compression spring on the shaft biasing the head away from the arrow launching assembly.

23. The push-away arrow rest of claim 18, further comprising a rotator lever rigidly connected to the arrow launcher assembly and aligned adjacent the head of the push rod assembly.

24. The push-away arrow rest of claim 18, wherein the push rod assembly is adjustable in length and biased tension.

25. A push-away arrow rest for use with a compound bow, the bow comprising a riser having a shelf, a cable guard, a cable slide and at least one tuning cable, the rest comprising:

a) an arrow launcher assembly biased to an upward arrow support position wherein the arrow support member is supported by a base with a shaft biased and rotatably mounted in a barrel fixedly secured in relation to the riser; and b) a push rod assembly biased away from the arrow launcher assembly adapted to push the arrow launcher assembly downwardly out of the way of an arrow after the arrow is drawn and released by the bow, wherein the tuning cable strikes the push rod assembly which in turn strikes and pushes the arrow launcher assembly downwardly out of the way of the arrow as the arrow is launched, and wherein the push rod assembly comprises a shaft with a head for striking and moving the arrow launcher assembly downwardly from it biased upward position, a cable bumper on the shaft opposite the head adjacent the tuning cable and a compression spring on the shaft biasing the head away from the arrow launching assembly.

26. The push-away arrow rest of claim 25, wherein the push rod assembly is fixedly secured in relation to the riser.

27. The push-away arrow rest of claim 26, wherein the push rod assembly is mounted on a barrel fixedly secured to the riser.

28. The push-away arrow rest of claim 25, further comprising a rotator lever rigidly connected to the arrow launcher assembly and aligned adjacent the head of the push rod assembly.

29. The push-away arrow rest of claim 25, wherein the push rod assembly is adjustable in length and biased tension.

* * * * *